United States Patent [19]

Pachmayr et al.

[11] 4,378,651

[45] Apr. 5, 1983

[54] REINFORCED CUSHIONED GUN GRIP

[75] Inventors: Frank A. Pachmayr, Los Angeles; Jack R. Farrar, Whittier, both of Calif.

[73] Assignee: Pachmayr Gun Works, Inc., Los Angeles, Calif.

[21] Appl. No.: 184,757

[22] Filed: Sep. 8, 1980

[51] Int. Cl.[3] ..... F41C 23/00

[52] U.S. Cl. ..... 42/71 P

[58] Field of Search ..... 42/71 P

[56] References Cited

U.S. PATENT DOCUMENTS

| | | | |
|---|---|---|---|
| 3,672,084 | 6/1972 | Pachmayr | 42/71 P |
| 3,815,270 | 6/1974 | Pachmayr | 42/71 P |
| 4,043,066 | 8/1977 | Pachmayr et al. | 42/71 P |
| 4,132,024 | 1/1979 | Pachmayr et al. | 42/71 P |
| 4,148,149 | 4/1979 | Pachmayr et al. | 42/71 P |
| 4,199,887 | 4/1980 | Hogue | 42/71 P |
| 4,242,824 | 1/1981 | Pachmayr et al. | 42/71 P |
| 4,286,401 | 9/1981 | Pachmayr et al. | 42/71 P |

*Primary Examiner*—Charles T. Jordan

*Attorney, Agent, or Firm*—William P. Green

[57] ABSTRACT

A cushioned gun grip includes two elastomeric grip bodies receivable at opposite sides of a gun handle and containing reinforcing plates stiffer than the elastomeric material and having forward portions extending inwardly toward one another in front of the gun handle and within inwardly turned forward flanges formed by the elastomeric material, with the rear edges of the elastomeric bodies and contained reinforcing plates desirably being spaced apart for reception at opposite sides of a rear surface of the handle in a manner leaving that rear surface exposed.

14 Claims, 9 Drawing Figures

REINFORCED CUSHIONED GUN GRIP

BACKGROUND OF THE INVENTION

This invention relates to improved gun grips adapted to be attached to the handle of a pistol or the like and having resiliently deformable surfaces for contacting a user's hand in cushioned relation.

U.S. Pat. No. 3,672,084 issued June 27, 1972 shows a cushioned pistol grip assembly formed of two sections which are receivable at opposite sides of a pistol handle and are connectable together through the handle, with each of the sections being formed as a molded body of elastomeric material, preferably neoprene rubber, containing a reinforcing plate of metal or other material stiffer than the elastomeric material to give some rigidity to the sections. The two elastomeric bodies meet in a central vertical front to rear plane of the gun. Other cushioned pistol grip arrangements have been shown in U.S. Pat. Nos. 3,815,270; 4,043,066; 4,132,024 and 4,148,149, and in U.S. patent applications Ser. Nos. 764 filed Jan. 3, 1979, now U.S. Pat. No. 4,242,824, and 32,170 filed Apr. 23, 1979, now U.S. Pat. No. 4,286,401.

SUMMARY OF THE INVENTION

A purpose of the present invention is to provide a gun grip which is similar to that shown in U.S. Pat. No. 3,672,084 but is in certain respects more effectively reinforced, and which preferably is constructed to facilitate holding and firing of the gun by a person having relatively small hands. With regard to reinforcement, the grip sections are so designed that their reinforcing plates extend within the elastomeric bodies of the sections into very close proximity to edge surfaces of those bodies, to provide more effective and permanent retention of those surfaces in proper abutting engagement with their coacting parts in a manner maintaining an optimum appearance of the overall grip and handle combination and preventing unwanted distortion or displacement of the elastomeric material near the specified surfaces in use. At the front of the gun handle, the elastomeric material of the two deformable grip bodies forms flanges which extend inwardly toward one another and desirably into abutting engagement, and the reinforcing plates embedded in those elastomeric bodies have forward portions which extend laterally toward one another within the mentioned inturned flanges and to positions in front of the pistol handle, to retain the forward flanges of the elastomeric bodies against distortion and in proper contact with one another. The two flanges desirably have planar inner surfaces which contact one another in front of the pistol handle, and the reinforcing plates preferably extend generally toward those surfaces and almost to the planes of the surfaces to maintain the surfaces in contact.

At the rear of the gun handle, the elastomeric bodies of the two grip sections preferably do not contact one another, but rather are spaced laterally apart and received at opposite sides of a rear portion of the handle, with a back surface of the handle exposed between the rear edges of the two bodies. The elastomeric grip elements thus do not project rearwardly beyond the back portion of the gun handle itself, and therefore do not add to the overall front to rear dimension between the back of the gun handle and the trigger. Consequently, the grip enables a person with relatively small hands to hold and fire the gun. The reinforcing plates may have rear edges which are embedded within the rear edge portions of the elastomeric bodies and desirably extend into close proximity to the opposite sides of the rear portion of the gun handle, to maintain a neat abutting contact between the grip sections and handle at that location.

BRIEF DESCRIPTION OF THE DRAWINGS

The above and other features and objects of the invention will be better understood from the following detailed description of the typical embodiment illustrated in the accompanying drawings, in which.

DESCRIPTION OF THE PREFERRED EMBODIMENT

Figure 1:
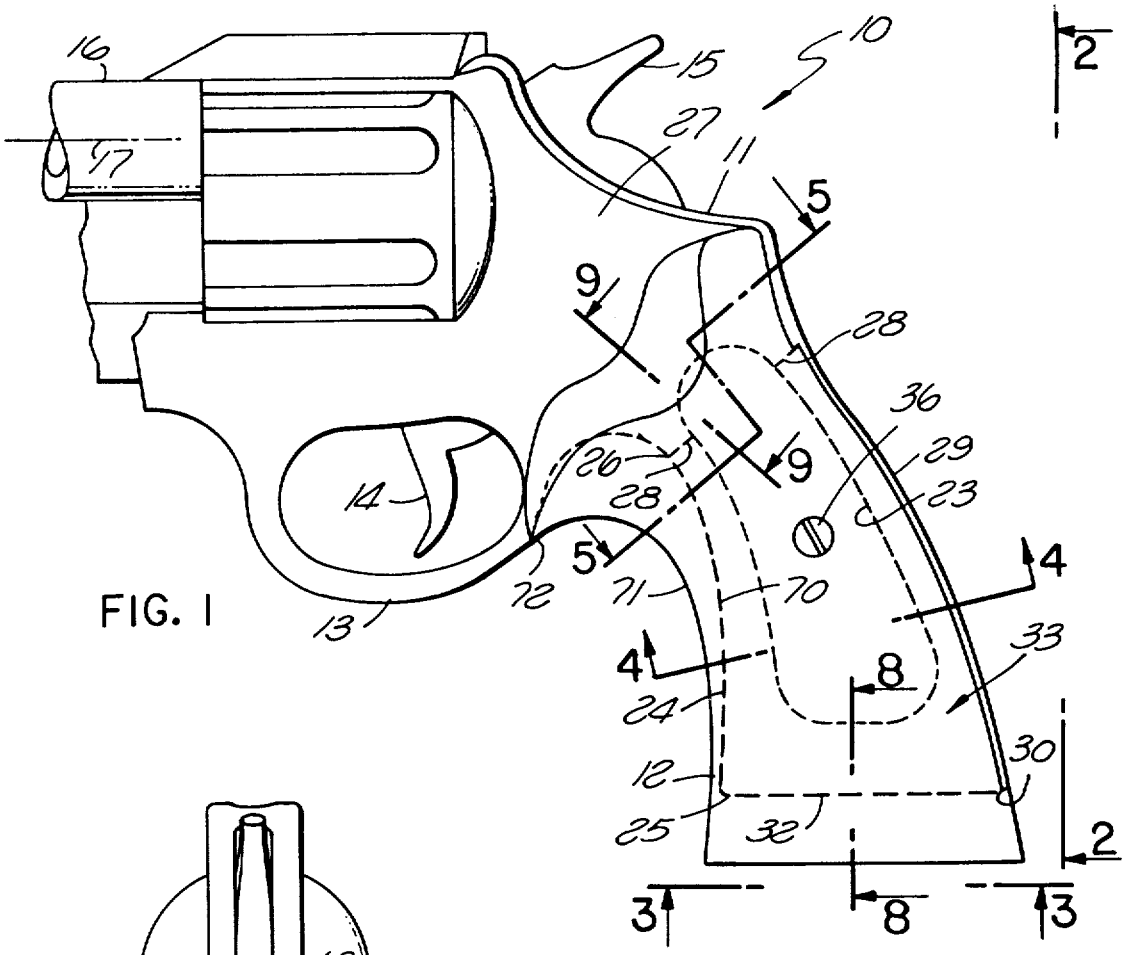
FIG. 1 is a fragmentary side view of a revolver to which a cushioned grip assembly embodying the invention is attached.
Figure 2:
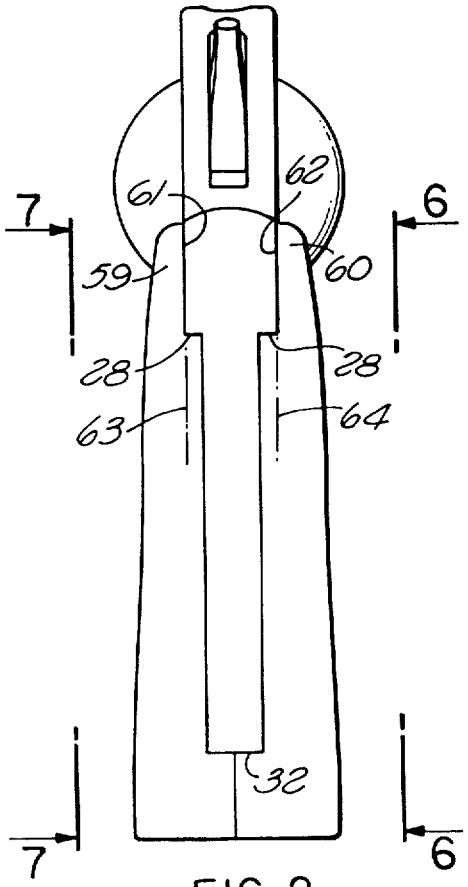
FIG. 2 is a rear view taken on line 2—2 of FIG. 1.
Figure 4:
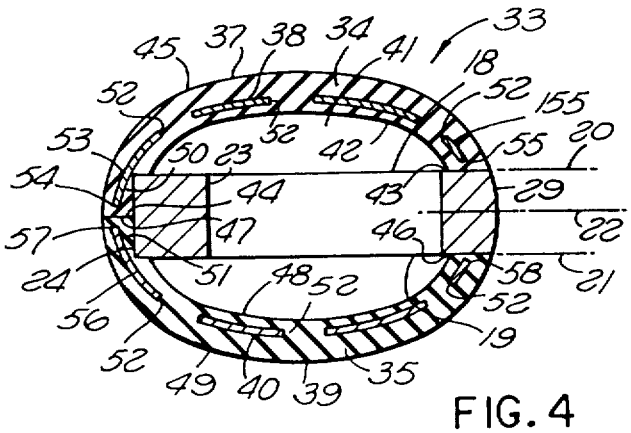
FIGS. 4 and 5 are transverse sections through the pistol handle and grip taken on lines 4—4 and 5—5 respectively of FIG. 1.
Figure 6:
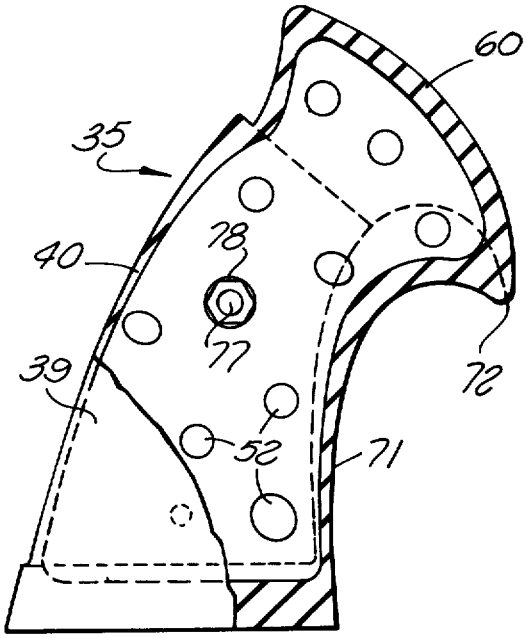
FIGS. 6 and 7 are side views taken on lines 6—6 and 7—7 respectively of FIG. 2, with the elastomeric material broken away to show the configurations of the reinforcing plates of the two grip sections.
Figure 7:
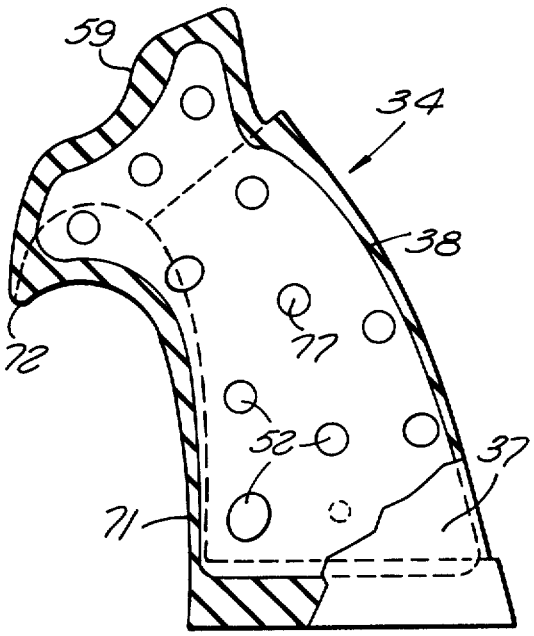
Figure 5:
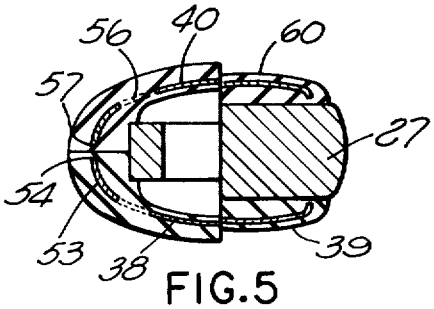
Figure 9:
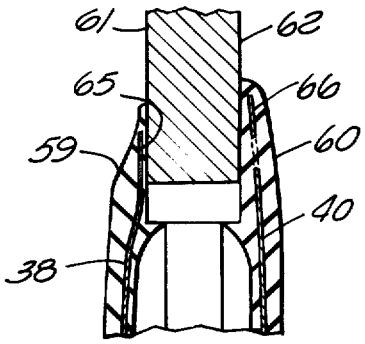
FIGS. 8 and 9 are sections taken on lines 8—8 and 9—9 of FIG. 1.

The pistol 10 typically illustrated in FIG. 1 is a revolver of conventional construction, having a rigid metal frame 11 with a handle portion 12 and a trigger loop portion 13 within which a trigger 14 is movable to release the hammer 15 for firing a cartridge to force a bullet through barrel 16 along the axis 17 of the barrel. Handle portion 12 of the gun frame has planar opposite side surfaces 18 and 19 lying in two spaced parallel planes 20 and 21 located at opposite sides of and spaced equal distances from a central vertical front to rear plane 22 of the gun which contains axis 17 of the barrel. A vertically elongated opening 23 may extend through handle 12 and have the outline configuration illustrated in FIG. 1. The front of the handle is defined by a forwardly facing surface 24 extending perpendicular to planes 20, 21 and 22 and which in extending upwardly from the lower end 25 of that surface may have the slightly curving configuration illustrated in FIG. 1, to first advance slightly rearwardly as surface 24 extends upwardly, and then curve slightly forwardly at the upper end of that surface to a location 26 at which an upper wider portion 27 of the frame commences, with downwardly and rearwardly facing shoulders 28 being formed at the juncture of the handle and the upper wider portion 27 of the frame. The back side of handle 12 is defined by a rear surface 29 which extends between and is approximately perpendicular to planes 20 and 21 of the side surfaces 18 and 19 of the handle, and which curves gradually forwardly as it advances upwardly from the lower extremity 30 of surface 29 to the location of shoulders 28. As seen in FIG. 4, surface 29 may have a slight convex curvature in extending between surfaces 18 and 19. Bottom surface 32 of handle 12 may be planar and extend horizontally in the FIGS. 1 and 2 normal position of the gun.

The grip assembly 33 embodying the present invention includes a left section 34 of the grip and a right section 35, which sections are received at opposite sides of handle 12 and are clamped thereagainst by a screw 36 extending through opening 23 in the gun frame and interconnecting the two sections. The left-hand section 34 includes a molded body 37 of elastomeric material and a reinforcing plate 38 embedded in and stiffer than body 37. Similarly, the right-hand section 35 includes an elastomeric body 39 and a stiffer reinforcing plate 40 embedded therein. Preferably, the elastomeric material of which bodies 37 and 39 are formed is neoprene or another appropriate rubber, desirably having a Shore hardness on the A scale between about 35 and 55. The reinforcing plates 38 and 40 are desirably essentially rigid, and may be formed of sheet steel or other rigid metal stamped and cut to the illustrated configuration. The two sections 34 and 35 may be approximately symmetrical with respect to one another, with the plane of symmetry being the central vertical front to rear plane 22 of FIG. 4.

Describing first of all the sectional configuration of grip sections 34 and 35 at the location of the generally horizontal plane in which FIG. 4 is taken, the elastomeric body 37 of the left-hand section 34 as seen in FIG. 4 preferably has an outwardly bowed configuration defining an inner recess 41 having an inner surface 42 which curves concavely from a rear edge surface 43 lying in the previously mentioned plane 20 and engageable with side surface 18 of the gun handle to a surface 44 at the front of the section lying in central vertical plane 22. The outer surface 45 of elastomeric body 37 curves convexly and generally parallel to inner surface 42, and as it approaches rear edge surface 43 the outer surface 45 is essentially aligned with and forms essentially a continuation of rear surface 29 of the gun handle. The right-hand section 35 of the grip as viewed in FIG. 4. has a curved configuration which is the mirror image of the discussed curvature of section 34, with the elastomeric body 39 of section 35 extending from a rear edge surface 46 lying in plane 21 and engageable with handle surface 19 to a forward surface 47 lying in central plane 22 and adapted to abut against surface 44 of section 34. The inner concavely curved surface 48 of body 39 forms a recess similar to recess 41 of section 34, while the outer surface 49 of section 35 is essentially aligned at the rear portion of the handle with the back surface 29 of the handle to form in effect a continuation thereof. Directly in front of handle 12, the elastomeric bodies 37 and 39 may be considered as forming front flanges 50 and 51 of such elastomeric material meeting at planar vertical surfaces 44 and 47.

The reinforcing plate 38, as viewed in the plane in which FIG. 4 is taken, is curved concavely in essential correspondence with the elastomeric body 37 within which it is embedded. This plate and plate 40 of the other section both desirably contain apertures 52 distributed over their entire area through which the elastomeric material extends in order to enhance the bond between the rubber and metal parts. The forwardmost portion 53 of reinforcing plate 38 extends laterally inwardly toward, and preferably generally perpendicular to, surfaces 44 and 47, to an edge 54 of plate 38 which is very closely proximate to the vertical central plane 22 of the gun, desirably being covered by only a very thin layer of the elastomeric material at surface 44. Similarly, the rear edge portion 155 of plate 38 extends inwardly toward, and is preferably generally perpendicular to, rear edge surface 43 of the elastomeric body 37, and its edge 55 is received in closely proximate relation to surface 43, desirably being covered by only a thin layer of the elastomeric material at that surface. The plate 40 in elastomeric body 39 also has a forward edge portion 56 located in front of handle 12 of the gun, and extending toward and desirably essentially perpendicular to surface 47, to an edge 57 of the plate received closely proximate to surface 47 and covered by only a very thin layer of rubber at that surface. The rear edge portion 58 of plate 40 extends toward and preferably generally perpendicular to surface 46, and is desirably covered by only a thin layer of rubber at that surface. Edges 54 and 57 at the front of the plates are thus very closely proximate one another, and rear edges 55 and 58 of the plates are very closely proximate the opposite side surfaces of the rear portion of the handle.

The discussed complementary symmetrical concavely curved configuration of the two handle sections, including their elastomeric bodies and reinforcing plates, continues above the plane of FIG. 4, and desirably also beneath that plane, but with the front to rear dimension and the size of the grip sections gradually reducing as those sections advance upwardly toward the location of shoulders 28. Essentially this same configuration of the two sections may continue from just above the lowermost extremity of handle 12 of the gun to the location of shoulders 28 of the gun frame.

Above shoulders 28, the two elastomeric bodies 37 and 39 may have upper portions 59 and 60 with inner planar parallel surfaces 61 and 62 (FIG. 2) engaging parallel opposite side surfaces of the upper portion 27 of the gun frame and lying in planes 63 and 64 spaced apart a distance greater than the discussed planes 20 and 21 of the opposite side surfaces of the gun handle. Within these upper portions 59 and 60 of the elastomeric bodies, the contained reinforcing plates 38 and 40 may have upper portions 65 and 66 extending generally parallel to and closely proximate the inner surfaces 61 and 62 of the elastomeric bodies but covered by thin layers of the elastomeric material.

The flanges 50 and 51 at the front of handle 12 have rear surfaces 70 (FIG 1) which are engageable with the front surface 24 of the handle and follow its curvature, and have front surfaces 71 which are aligned with one another and which are engageable by a user's fingers during firing of the gun. The upper portions of the surfaces 70 and 71 curve progressively forwardly as they advance upwardly, with the abutting planar surfaces 44 and 47 continuing to a forward extremity 72 of the flanges.

Figure 3:
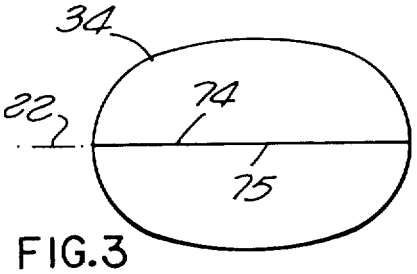
FIG. 3 is a bottom view taken on line 3—3 of FIG. 1.
Figure 8:
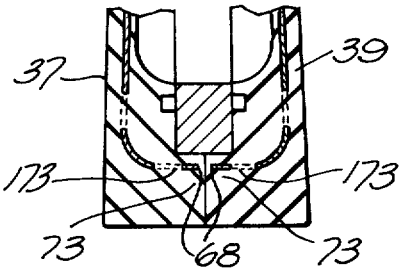

At the bottom of the two grip sections 34 and 35, the recesses 41 and 48 within these concave sections are essentially closed by horizontally turned bottom walls 73 of the sections (FIGS. 3 and 8) which extend beneath the undersurface of handle 12 into contact with one another at vertical planar parallel surfaces 74 and 75 lying in central vertical front to rear plane 22. The reinforcing plates 38 and 40 have inwardly turned bottom walls 173 within bottom portions 73 of the elastomeric bodies and extending beneath the handle of the gun into close proximity to one another and to surfaces 74 and 75 of the elastomeric material. The inner parallel edges 68 of the reinforcing plates may be covered by thin layers of the elastomeric material of bodies 37 and 39.

The previously mentioned screw 36 for securing the two grip sections together may extend through openings 77 formed in body 37 and plate 38 of the left-hand section, with the shank of the screw extending through the opening in plate 38 and with its head being larger than that opening so that the head can bear tightly against the plate and pull it inwardly against the handle. After extension through the openings 77 of the left-hand section and through the passage or opening 23 in the frame of the gun, the shank of the screw may connect threadedly into a nut element 78 secured rigidly to plate 40 of the right-hand section of the grip, so that tightening of the screw relative to nut 38 will pull the two sections together and against the handle.

When the two sections are thus mounted on the gun handle, the surfaces which are exposed for contact with the hand of a user during firing of the gun are the outer slightly resiliently deformable surfaces of the elastomeric material of the two grip sections, to thus cushion the contact of the user's hand with the gun, provide a high friction gripping engagement with the gun, and absorb recoil by virtue of the resilience of the rubber. The extension of the forward edge portions of the two reinforcing plates 38 and 40 into elastomeric flanges 50 and 51, and to positions directly in front of handle 12 and closely proximate one another and surfaces 44 and 47 of the elastomeric bodies enables the forward portions of the reinforcing plates to very effectively retain the elastomeric material of the flanges in essentially fixed positions of tight abutting engagement in which an attractive accurate alignment of the front surfaces of the elastomeric flanges is maintained at the plane of their abutment. Similarly, the spaced rear edge surfaces 43 and 46 are held in firmly abutting engagement with the opposite sides of the back portion of the handle by virtue of extension of the edges 54 and 58 of the reinforcing plates into close proximity to surfaces 43 and 46. Because the rear portions of the two grip sections do not extend rearwardly of the back surface 29 of the handle, but rather have their outer surfaces aligned therewith and at opposite sides thereof, the distance in a front to rear direction from back surface 29 of the handle to the trigger is not increased by use of the present grip assembly, and therefore a person with a relatively small hand can fire the gun as easily with use of the present grips as with conventional grips, while at the same time attaining the cushioning effect of the grips.

While a certain specific embodiment of the present invention has been disclosed as typical, the invention is of course not limited to this particular form, but rather is applicable broadly to all such variations as fall within the scope of the appended claims.

We claim:

1. A gun grip comprising:

two grip sections each including a body of elastomeric material and a reinforcing plate embedded in and more rigid than said elastomeric material;

said bodies of elastomeric material forming two side walls to be received at opposite sides respectively of a gun handle, and which have rear edge portions adapted to be received at opposite sides of a back surface of the gun handle in a spaced relation leaving said surface exposed between said rear edge portions when the bodies are mounted on the handle;

said bodies of elastomeric material forming two front flanges of said elastomeric material projecting inwardly toward one another at forward edges of said two side walls respectively and at locations to be received in front of said handle;

said reinforcing plates having main portions which are embedded in and reinforce said side walls of the elastomeric material and which have rear edges within said rear edge portions of the elastomeric side walls spaced apart for reception at opposite sides of said rear surface of the handle;

said reinforcing plates having forward portions projecting inwardly toward one another within said flanges of the elastomeric material at locations to be received in front of said gun handle and closer together than are said spaced rear edges of the plates.

2. A gun grip as recited in claim 1, in which said front flanges of said two bodies of elastomeric material have surfaces which engage one another in front of the handle when the two sections are attached to the handle, said forward portions of the reinforcing plate having edges which are closely proximate said surfaces and are closely proximate one another in the mounted condition of the gun grip sections.

3. A gun grip as recited in claim 1, in which said front flanges of the two bodies of elastomeric material have planar surfaces which engage one another in a central front to rear plane of the gun when the two grip sections are mounted on said handle, said forward portions of the reinforcing plates extending inwardly toward one another and toward said planar surfaces and having edges closely proximate said planar surfaces and which are received closely proximate one another when the surfaces are in engagement.

4. A gun grip as recited in claim 3, in which said rear edge portions of said side walls of the elastomeric bodies have inner planar surfaces engageable with opposite sides of said gun handle and lying in planes which are parallel to said planar surfaces of said flanges but spaced in opposite directions therefrom, said rear edges of the reinforcing plates being received in closely proximate relation to said planar surfaces of said rear edge portions of said elastomeric side walls to be received closely proximate the gun handle when the two grip sections and mounted thereon.

5. A gun grip as recited in claim 4, in which said reinforcing plates have bottom walls turned inwardly toward one another beneath a bottom portion of the gun handle and received in close proximity to one another.

6. A gun grip as recited in claim 5, in which said two elastomeric bodies contain cavities defined by inner surfaces which, in extending from said front flanges to said rear edge portions of said side walls curve concavely outwardly to a spaced relation greater than the spacing between said rear edge portions of the side walls and then curve back inwardly to those rear edge portions, said reinforcing plates being curved concavely in essential correspondence with said inner surfaces of the elastomeric bodies.

7. A gun grip as recited in claim 1, in which said reinforcing plates have bottom walls turned inwardly toward one another beneath a bottom portion of the gun handle and received in close proximity to one another.

8. A gun grip as recited in claim 1, in which said two elastomeric bodies contain cavities defined by inner surfaces which, in extending from said front flanges to said rear edge portions of said side walls curve concavely outwardly to a spaced relation greater than the spacing between said rear edge portions of the side walls and then curve back inwardly to those rear edge portions, said reinforcing plates being curved concavely in essential correspondence with said inner surfaces of the elastomeric bodies.

9. A gun grip as recited in claim 1, in which said elastomeric bodies and said reinforcing plates therein have upper portions receivable at opposite sides of a frame of the gun above said handle portion thereof and which are spaced apart a distance greater than said rear edge portions of the elastomeric bodies when said sections are mounted on the gun.

10. A gun grip comprising:

two grip sections each including a body of elastomeric material and a reinforcing plate embedded in and more rigid than said elastomeric material;

said bodies of elastomeric material forming two side walls to be received at opposite sides respectively of a gun handle, and two flanges formed of said elastomeric material projecting inwardly toward one another at forward edges of said two side walls respectively and at locations to be received in front of said handle;

said reinforcing plates having main portions embedded in and reinforcing said two side walls respectively of the elastomeric material, and forward portions projecting inwardly toward one another within said two flanges of the elastomeric material at locations to both be received in front of said gun handle.

11. A gun grip as recited in claim 10, in which said front flanges of said two bodies of elastomeric material have surfaces which engage one another in front of the handle when the two sections are attached to the handle, said forward portions of the reinforcing plate having edges which are closely proximate said surfaces and are closely proximate one another in the mounted condition of the gun grip sections.

12. A gun grip as recited in claim 10, in which said front flanges of the two bodies of elastomeric material have planar surfaces which engage one another in a central front to rear plane of the gun when the two grip sections are mounted on said handle, said forward portions of the reinforcing plates extending inwardly toward one another and toward said planar surfaces and having edges closely proximate one another when the surfaces are in engagement.

13. A gun grip as recited in claim 10, in which said two bodies of elastomeric material have bottom walls extending inwardly into contact with one another beneath the gun handle, said reinforcing plates having bottom walls turned inwardly toward one another within said bottom walls of said bodies and having inner edges received in close proximity to one another beneath the handle.

14. A gun grip as recited in claim 10, in which said two side walls of said elastomeric bodies have inner and outer surfaces which curve concavely generally parallel to one another, said reinforcing plates being curved concavely in essential correspondence with and between said inner and outer surfaces of the elastomeric bodies.

* * * * *